US007293676B2

(12) United States Patent
Liston et al.

(10) Patent No.: US 7,293,676 B2
(45) Date of Patent: Nov. 13, 2007

(54) DISPENSER APPARATUS

(75) Inventors: Lee Liston, Coogee (AU); Robbie Wells, Coogee (AU)

(73) Assignee: Scholle Corporation, Irvine, CA (US)

( * ) Notice: Subject to any disclaimer, the term of this patent is extended or adjusted under 35 U.S.C. 154(b) by 143 days.

(21) Appl. No.: 10/682,678

(22) Filed: Oct. 9, 2003

(65) Prior Publication Data

US 2005/0077321 A1 Apr. 14, 2005

(51) Int. Cl.
*B65D 5/72* (2006.01)
*B65D 47/04* (2006.01)

(52) U.S. Cl. ..... 222/185.1; 222/498; 222/501; 222/517; 222/563

(58) Field of Classification Search ..... 222/185.1, 222/498, 501, 505, 511, 517, 544, 563
See application file for complete search history.

(56) References Cited

U.S. PATENT DOCUMENTS

| | | | | |
|---|---|---|---|---|
| 2,990,980 | A | | 7/1961 | Gronemeyer |
| 3,400,866 | A | | 9/1968 | Fattori |
| 3,443,726 | A | | 5/1969 | Scholle |
| 3,776,434 | A | | 12/1973 | Christensen et al. |
| 3,972,452 | A | | 8/1976 | Welsh |
| 4,135,649 | A | | 1/1979 | Baldwin et al. |
| 4,169,548 | A | | 10/1979 | Bond |
| 4,211,348 | A | | 7/1980 | Scholle |
| 4,248,362 | A | | 2/1981 | Welsh et al. |
| 4,444,340 | A | | 4/1984 | Bond et al. |
| 4,533,071 | A | | 8/1985 | Uhlig |
| 4,570,826 | A | | 2/1986 | Fattori |
| 4,666,064 | A | * | 5/1987 | Hoehn ..... 222/105 |
| 4,706,855 | A | | 11/1987 | Litwin |
| 4,711,380 | A | * | 12/1987 | Ulm ..... 222/153.07 |
| 4,787,538 | A | | 11/1988 | Fattori |
| 4,834,271 | A | | 5/1989 | Litwin |
| 5,000,359 | A | * | 3/1991 | Scholle et al. ..... 222/505 |

* cited by examiner

*Primary Examiner*—Joseph A. Kaufman
(74) *Attorney, Agent, or Firm*—The Watson IP Group, PLC; Jovan N. Jovanovic; Vladan M. Vasiljevic

(57) ABSTRACT

A dispensing apparatus comprising a spout and a spigot. The spout includes a tubular member. The tubular member includes a first end, a second end, an inside surface and an opening extending transversely through the tubular member between the first and second end thereof. The tubular member defines a cavity capable of receiving a flowable material therein. The spigot is attached to the inside surface of the tubular member. The spigot includes a peripheral wall, a transverse wall and a handle. The peripheral wall includes an outer surface positionable over the opening. The transverse wall is coupled to the peripheral wall. The peripheral wall and the transverse wall cooperating to substantially seal the first end of the tubular member and the opening from the cavity of the tubular member. The handle is associated with at least one of the peripheral wall and the transverse wall. The handle member is capable of elastically deforming the outer surface of the peripheral wall to, in turn, place the opening in fluid communication with the cavity, while maintaining the substantial seal of the first end of the tubular member.

19 Claims, 3 Drawing Sheets

DISPENSER APPARATUS

BACKGROUND OF THE INVENTION

1. Field of the Invention

The present invention relates in general to a dispenser apparatus, and more particularly a dispenser apparatus having a spout and a spigot for use in association with, for example, flexible packaging often utilized in what is commonly known as a "bag in box" arrangement for storage and dispensing of a flowable material.

2. Background Art

The use of bag in box packaging has become increasingly widespread, especially at the consumer and retail level. For example, the wine industry has increasingly stocked store shelves with wine packaged within bag in box packaging. Such packaging generally includes a flexible inner container having a dispenser (i.e., a spout and spigot), all of which are positioned within a rigid outer container. The dispenser is designed so that an end user can extend the spout and spigot through a wall of the rigid container and dispense desired amounts into, for example a glass. As the flowable material is consumed, the inner bag collapses. Certain of the dispensers rely upon a spigot that is elastically deformable so that, upon manipulation by the hand of a user, an opening is revealed, through which flowable material is directed. When released, the spigot returns to an original sealing configuration due to the resilience of the material. While many such spouts have been developed, there have been certain drawbacks.

One such drawback is that certain spigots extend around the spout to cover a large portion of same. Such a spigot, which is generally of a soft and pliable material, is fully exposed and obtrusive. As a result, any inadvertent impact imparted to the spigot during handling can dislodge the spigot from the spout resulting in the uncontrolled leaking and the loss of the flowable material contained within the container. Furthermore, an external spigot is often detracts from the otherwise clean appearance of the container.

Another such drawback of prior art containers is that the dispensing opening is generally found on the spigot. As a result the spigot incorporates a multitude of functions, i.e., the dispensing of and the directing of fluid. As the spigot performs the dispensing function (i.e., the opening extends through the spigot), and as the spigot is generally of a flexible and relatively soft material, the opening can become distorted. In particular, the size, shape and pour characteristics of the resulting opening can be adversely affected, leading to an inability for the user to properly control the dispensing of flowable material.

Further still, many of the prior art containers are difficult to actuate by the fingers of the user and difficult to control with a single hand. Indeed, the shapes and dimensions of the actuating handles and the outer surface of the spout or spigot surrounding the opening remain difficult to grasp and retain.

Accordingly, it is an object of the invention to provide a spigot which is positioned within the spout.

It is another object of the invention to provide a spigot which is protected by the spout.

It is yet another object to provide a dispensing apparatus which is structurally configured for ease of handling and manipulation.

It is another object of the invention to provide a dispensing apparatus wherein the dispensing opening is formed into the spout and the opening of which is controlled by the spigot.

These objects as well as other objects of the present invention will become apparent in light of the present specification, claims, and drawings.

SUMMARY OF THE INVENTION

A dispensing apparatus comprising a spout and a spigot. The spout includes a tubular member. The tubular member includes a first end, a second end, an inside surface and an opening extending transversely through the tubular member between the first and second end thereof. The tubular member defines a cavity capable of receiving a flowable material therein. The spigot is attached to the inside surface of the tubular member. The spigot includes a peripheral wall, a transverse wall and a handle. The peripheral wall includes an outer surface positionable over the opening. The transverse wall is coupled to the peripheral wall. The peripheral wall and the transverse wall cooperate to substantially seal the first end of the tubular member and the opening from the cavity of the tubular member. The handle is associated with at least one of the peripheral wall and the transverse wall. The handle member is capable of elastically deforming the outer surface of the peripheral wall to, in turn, place the opening in fluid communication with the cavity, while maintaining the substantial seal of the first end of the tubular member.

In a preferred embodiment, the tubular member of the spout further comprises an outside surface. The outside surface of the tubular member further includes a finger retention surface. In one such preferred embodiment, the finger retention surface comprises a depressed region and a raised region. The raised region is positioned between the depressed region and the first end of the tubular member. In another such embodiment, the raised region comprises a substantially uniform circular configuration having a first diameter and the depressed region comprises a substantially uniform circular configuration having a second diameter. The substantially uniform circular configurations are substantially concentric and the first diameter is greater than the second diameter.

In another preferred embodiment, the tubular member comprises a substantially cylindrical cross-sectional area. In one such embodiment, a diameter of the inside surface of the tubular member proximate the first end is substantially equal to a diameter of the inside surface of the tubular member proximate the second end.

In a preferred embodiment, the tubular member further includes an outwardly extending flange positioned proximate the second end of the tubular member.

In another preferred embodiment, the spout further comprises a first mating structure and the spigot further comprises a second mating structure. In such an embodiment, the first mating structure and the second mating structure cooperate to substantially axially retain the spout relative to the spigot. In one such embodiment, at least a portion of the first mating structure is positioned between the first end of the tubular member and the opening of the tubular member. In another such embodiment, the first mating structure comprises an annular channel encircling the inside surface of the tubular member. In another such embodiment, the second mating structure comprises a annular ring encircling the outside surface of the peripheral wall. In another such embodiment, the annular channel is substantially transverse to the tubular member. Preferably, the tubular member includes an outside surface having a raised region, the annular channel substantially corresponds the raised region positioned on the outside surface of the tubular member.

In a preferred embodiment, the handle member of the spigot includes a concave arcuate configuration to facilitate the grasping of and retention by a finger of a user.

In another preferred embodiment, the peripheral wall and the transverse wall of the spigot are substantially free of any openings extending therethrough.

In yet another preferred embodiment, the peripheral wall and the transverse wall are substantially perpendicular to each other.

Preferably, the dispensing apparatus further comprises an adhesive associated with each of the spout and the spigot, the adhesive further facilitating the attachment thereof.

In a preferred embodiment, the tubular member further includes a directing member associated with the opening.

In one embodiment, the spigot comprises an integrated molded component.

BRIEF DESCRIPTION OF THE DRAWINGS

The invention will now be described with reference to the drawings wherein.

DETAILED DESCRIPTION OF THE INVENTION

Figure 1:
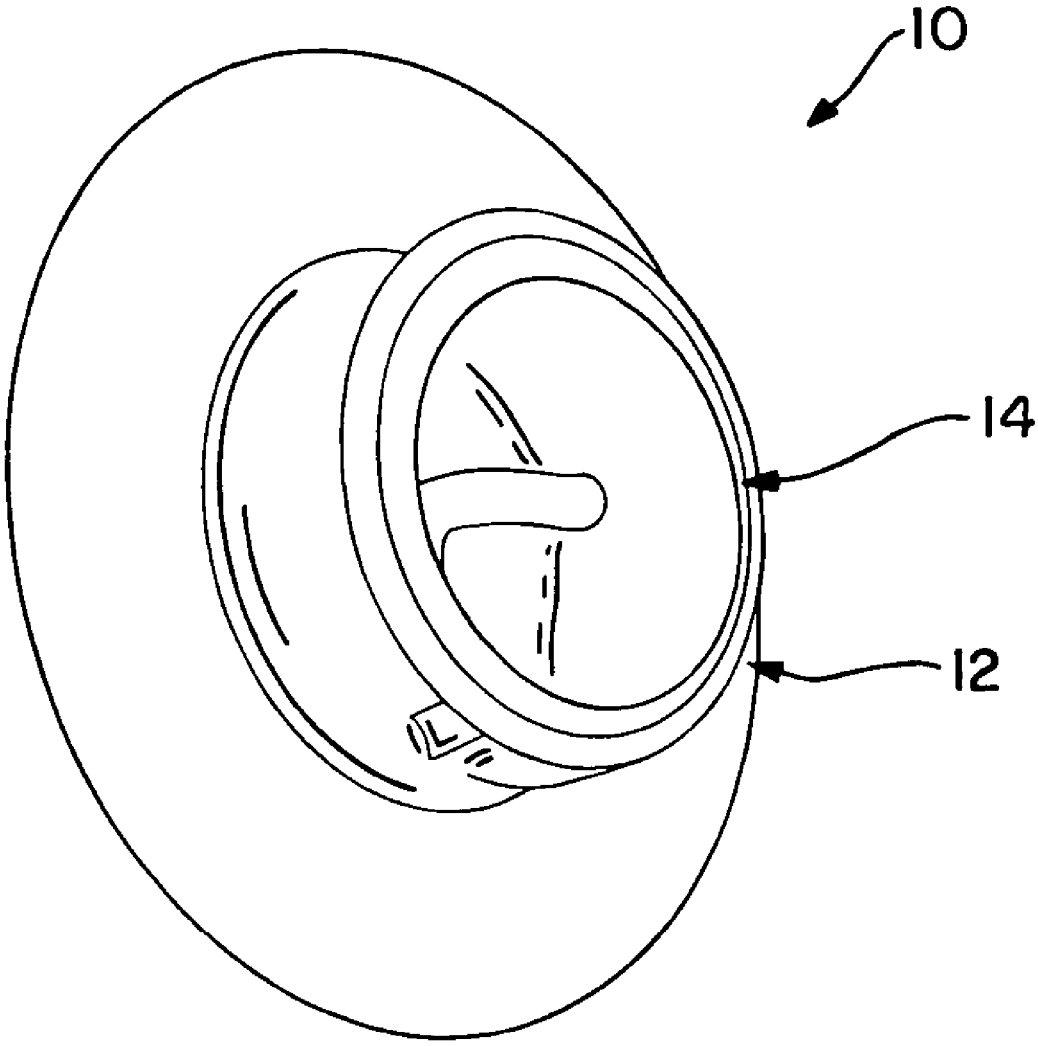
FIG. 1 of the drawings is a perspective view of the dispensing apparatus of the present invention.

While this invention is susceptible of embodiment in many different forms, there is shown in the drawings and described herein in detail a specific embodiment with the understanding that the present disclosure is to be considered as an exemplification of the principles of the invention and is not intended to limit the invention to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIGS. 1 through 4, dispensing apparatus 10 is shown as comprising spout 12 and spigot 14. The dispenser spout and spigot are configured for use in association with any number of different containers, such as container 100 shown in FIG. 5, for the dispensing of flowable material therefrom. Indeed, the invention does not require any particular container. Furthermore, the invention is not limited to use in association with any particular type of or class of flowable material.

Figure 4:
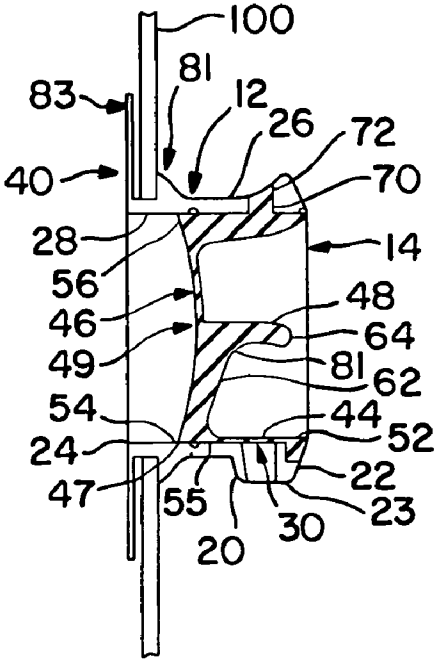
FIG. 4 of the drawings is a cross-sectional view of the dispensing apparatus of the present invention, taken generally about lines 4-4 of FIG. 3.

Spout 12 is shown in greater detail in FIG. 4 as comprising tubular member 20 and flange assembly 40. Tubular member 20 includes first end 22, second end 24, outside surface 26, inside surface 28 and opening 30. Tubular member 20 is shown in FIG. 4 as comprising a substantially circular cross-sectional configuration. Of course, other configurations and geometric shapes are contemplated, including, but not limited to ovals, elliptical configurations, polygons, and non-uniform configurations. It is contemplated that spout 12 may comprise a substantially rigid plastic composition (i.e., thermoset or thermoplastic material). In certain embodiments, the spouts are configured to comprise a transparent or translucent material. In other embodiments, an opaque material may be employed.

Inside surface 26 extends from first end 22 to second end 24 and includes first mating structure 70. First mating structure 70 comprises a annular channel encircling the inside surface of the tubular member. The annular channel is positioned so as to pass between opening 30 and first end 22. In the embodiment shown, the first mating structure extends substantially transverse to the tubular member (i.e., at an evenly spaced distance from first end 22). The annular channel comprises a substantially rectangular cross-sectional configuration, while other configurations (angular, square, circular, arbitrary) are likewise contemplated. Additionally, it is contemplated that the first mating structure may comprise a flange or other inwardly directed structure. In addition, it is also contemplated that the first mating structure may comprise a plurality of surface variations disposed upon inside surface 26 (i.e., a channel between two flanges, etc.). Other than the mating surface explained below, the remainder of the inside surface is substantially planar, while other configurations are contemplated.

Figure 2:
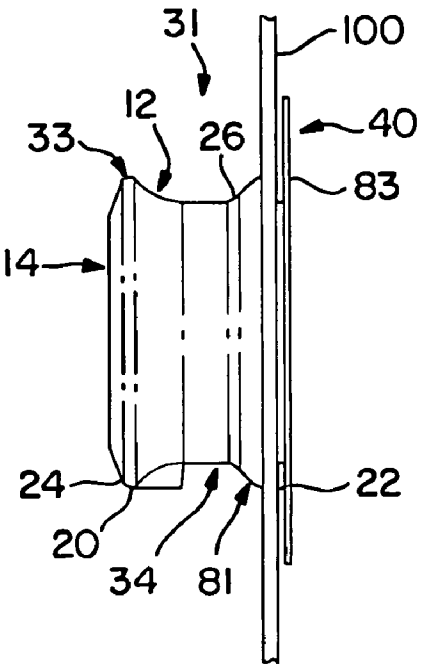
FIG. 2 of the drawings is side elevational view of the dispensing apparatus of the present invention.

Outside surface 28 of tubular member 20, as is shown in FIG. 2, includes finger retention surface 31. Finger retention surface 31 comprises depressed region 34 and raised region 33, wherein the raised region extends outwardly from a central axis of the tubular member a relative distance greater than the depressed region. The depressed region is positioned toward second end 24 with the raised region positioned between first end 22 and the depressed region. In the embodiment shown, the raised region corresponds to the annular channel disposed into the inside surface of the tubular member. As will be explained, the positioning of a depressed region and a raised region as explained above facilitates the positioning of the fingers of a user around the depressed region, and allows the fingers to leverage against the raised region during manipulation of the handle and the dispensing of flowable material. In the embodiment shown, the raised region and the depressed region comprise substantially concentric circular configurations wherein the diameter of the raised region is greater than the diameter of the recessed region. In other embodiments, different shapes may be utilized to enhance appearance and/or grasping functionality. In other embodiments, the raised region may further comprise at least one flange provided on the outside surface of the tubular member to facilitate engagement thereof by the fingers of a user.

Referring again to FIG. 4, opening 30 extends through the tubular member between second end 24 of the tubular member and annular channel 70. Directional member 23 may be integrally molded with opening 30 so as to channel flow from the opening into a steady stream of an appropriate dimension. The opening may include a substantially uniform cross-sectional configuration, such as a rectangular cross-sectional configuration, a oval cross-sectional configuration, a circular cross-sectional configuration, among others. Indeed, as the spout is substantially rigid, the directional member is capable of withstanding frequent impact without deformation. Of course, the invention is not limited to any particular configuration of the opening, and a number of different configurations are contemplated.

Figure 5:
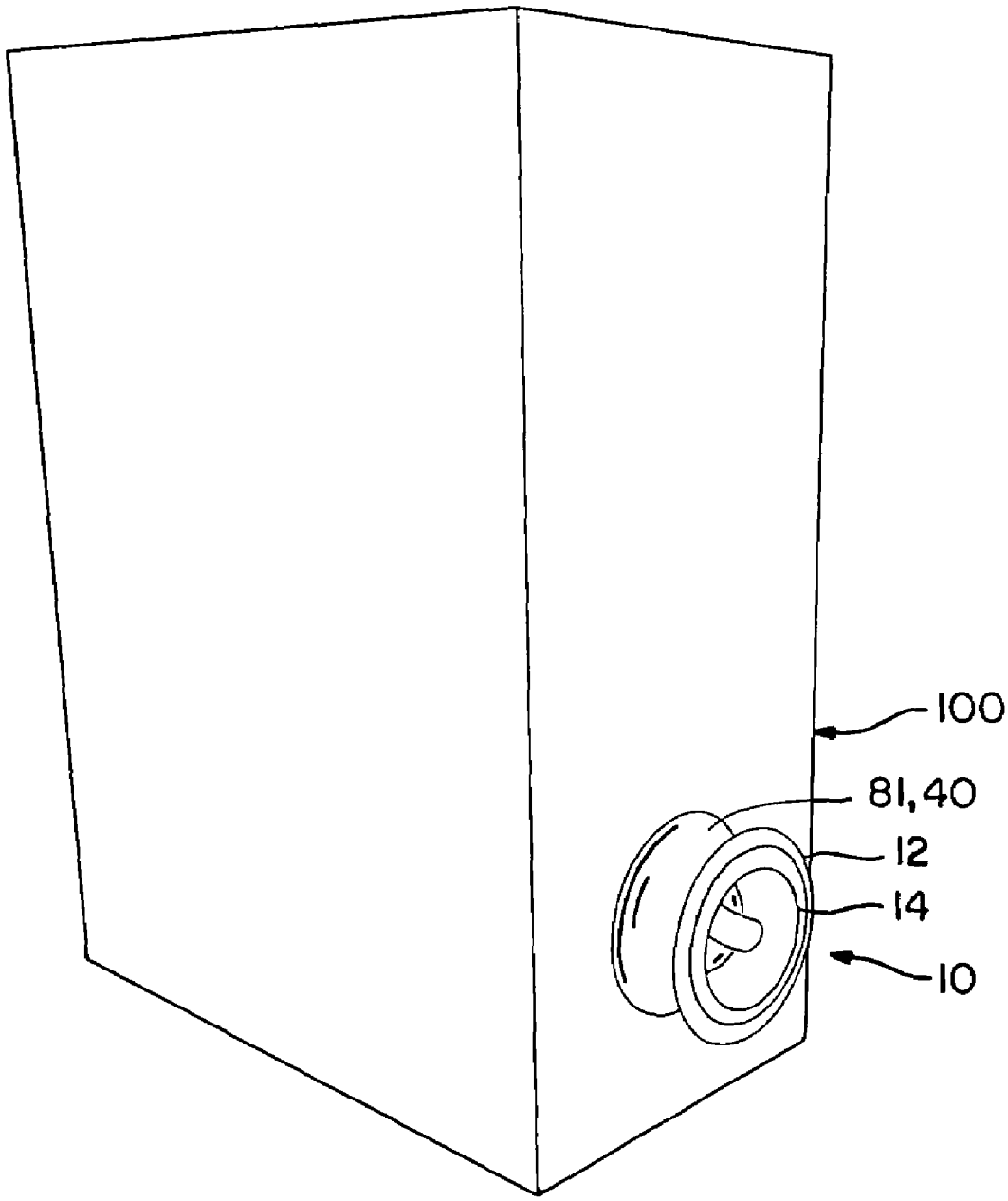
FIG. 5 of the drawings is a perspective view of a container employing the dispensing apparatus of the present invention.

Flange assembly 40, as is shown in FIGS. 2 and 4, includes first flange 81 and second flange 83. The flanges extends outwardly from the tubular member proximate the second end thereof. The flanges are spaced apart a predetermined distance so that a flexible container and/or a rigid container 100 may be positioned therebetween (FIGS. 2, 4 and 5). Additionally, the flanges comprise a different special configuration, however any number of different special configurations (i.e., shapes, thicknesses, sizes, etc.) are contemplated. It is contemplated that the flange may be integrally molded to the tubular member, or may be separate component that is attached (i.e., adhered, heat sealed, press-fit, etc.) to the tubular member.

Spigot 14 is shown in FIG. 4 as comprising peripheral wall 44, transverse wall 46 and handle 48. Spigot 14 generally comprises an integrated molded member which is substantially flexible and elastic. For example, the spigot may comprise polymer member, such as, for example, EMA, TPR, EVA or polyolefin material. Such a material has the rigidity to remain engaged with the spout, but includes the flexibility to facilitate operation of the opening actuation assembly in an elastic manner.

Peripheral wall 44, as is shown in FIG. 4, includes proximal end 52, distal end 54, outer surface 55. Outer surface includes peripheral bead 56. Peripheral bead 56 extends outwardly from the otherwise substantially planar outside surface, and, is positioned between distal end 54 of the peripheral wall and the position of the opening in the spout when the spout and the spigot are in an assembled configuration. Due to the proper relative dimensioning of the peripheral wall and the bead, the peripheral wall and the bead may be biased against the inside surface of the tubular member when the spigot is in a closed configuration. As such, the biasing enhances the seal over the opening. Moreover, the peripheral bead provides enhanced sealing and to preclude inadvertent leaking of the spout and spigot. Such a configuration is disclosed in U.S. Pat. No. 4,211,348 issued to Scholle, and the disclosure is incorporated by reference in its entirety.

As is shown in FIG. 4, peripheral wall 44 further includes second mating structure 72. Second mating structure comprises a annular ring which is configured so as to matingly engage first mating structure disposed on the inside surface of the tubular member. As such, in the embodiment shown, the second mating structure is substantially parallel to the transverse wall. The second mating structure comprises a substantially rectangular cross-sectional configuration. Of course, the cross-sectional shape of the second mating structure and the position thereof can be varied to match that of the first mating structure configuration (i.e., angular, square, circular, arbitrary). As with the first mating structure, it is contemplated that the second mating structure may comprise a channel other inwardly directed structure (i.e., again to mate with various of the possible configurations of the first mating structure).

Due to the relative dimensioning of the two mating surfaces, the first mating surface and the second mating surface are biased against each other (i.e., through an interference fit) to effectively form a seal that substantially precludes the passage of fluid thereacross and beyond first end 22. Optionally, an adhesive may be positioned between the mating surfaces to enhance the sealing properties of same. This seal precludes the passage of flowable material beyond the mating structures and beyond the first end of the tubular member.

Transverse wall 46 is shown in FIG. 4 as including outer edge 47 and central region 49. The outer edge of the transverse wall substantially uniformly engages peripheral wall 44 proximate distal end 54 thereof. The transverse wall and the peripheral wall cooperate to define actuation region 43. The transverse wall and the peripheral wall are substantially perpendicular. However, it is likewise contemplated that the transverse wall may be disposed obliquely relative to each other. The transverse wall may be fully integrated and molded with peripheral wall 44 to form a single fluid-impermeable member. It is contemplated that the thickness of the peripheral wall and the transverse wall may substantially correspond. Of course, varying thicknesses for each as well as non-uniform thicknesses are likewise contemplated. The transverse wall provides a support for the peripheral wall as well as an outward biasing force in certain embodiments (depending on the relative dimensions of the various components). As such, the transverse wall cooperates with the peripheral wall to substantially seal the first end of the tubular member and the opening from the cavity of the tubular member to preclude undesired flow of flowable material therethrough.

Figure 3:
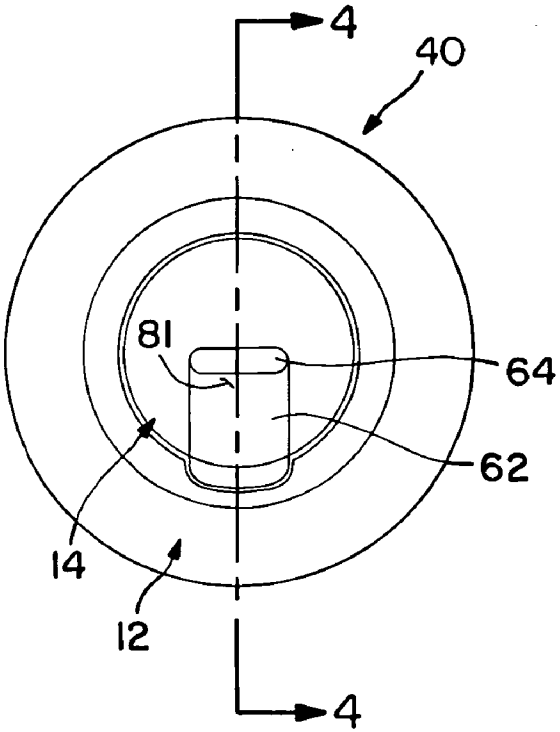
FIG. 3 of the drawings is front plan view of the dispensing apparatus of the present invention.

Handle member 48 is shown in FIGS. 3 and 4 as including lever base 62 and lever arm 64. Lever base 62 extends from outer edge 47 and peripheral wall 44 (proximate a position overlying opening 30 of the tubular member of the spout) inwardly toward central region 49 of transverse wall 46. Furthermore, lever arm 64 extends outwardly from transverse wall 46 into actuation region 43. In the embodiment shown, the lever base and the lever arm are integrally molded with the transverse wall and the peripheral wall to form a single integrated member.

In the embodiment shown, the lever arm and the lever base include a coextensive outer surface 81 having a concave arcuate configuration which is configured to substantially match the outer shape of a finger of a user. As such, a user can easily engage the outer surface of the engagable lever with a finger, and the shape thereof substantially cradles the finger and substantially precludes inadvertent and undesired slipping of the finger from the engagable lever during operation thereof.

To dispense flowable material from the spout and spigot, the user places his or her finger under lever arm 64 and lifts the lever arm in a generally upward direction. Lifting of the handle pulls a portion of the joined transverse wall 46 upwardly, and, in turn, pulls the joined peripheral wall (and associated peripheral bead) from contact and engagement with inside surface 28 of tubular member 20. As a result, opening 30 is in fluid communication with the cavity of the tubular member, and, flowable material is permitted to flow through the tubular member and the opening.

The cooperation of the mating structures in a biased arrangement provides a seal therebetween and, in turn, precludes the passage of flowable material beyond first end 22 of the tubular member, and maintains any dispensing of flowable material through opening 30.

Upon release, the resilience and elasticity of the spigot directs the components back into an original configuration wherein the peripheral wall overlies the opening severing communication therefrom. In turn, flow through the opening ceases. The elasticity and resilience of the material of the spigot facilitates repeated actuation of the handle and the repeated selective flow of flowable material through the opening of the tubular member of the spout.

Advantageously, with the foregoing structure, substantially the entirety of the spigot can be positioned within the spout, and it is not required that a portion of the spigot overlie and engage the outside surface of the spout. Thus, the relatively rigid spout can protect the relatively pliable spigot from inadvertent damage. Furthermore, the configuration of the handle member facilitates the grasping and retention of the handle member in a desired orientation without undue pressure and manipulation. Lastly, the placement of the opening in the spout rather than extending an opening through the spigot facilitates manufacturing of the spigot and enhances the rigidity of the spigot.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A dispensing apparatus comprising:

a spout including:

tubular member having a first end, a second end, an inside surface, an outside surface and an opening extending transversely through the inside surface and outside surface of the tubular member between the first and second end thereof, the tubular member defining a cavity capable of receiving a flowable material therein; and a spigot attached to the inside surface of the tubular member and not extending over the second end of the tubular member so as not to envelope the second end and the outer surface of the tubular member, the spigot including:

a peripheral wall having an outer surface positionable over the opening;

a transverse wall coupled to the peripheral wall, the peripheral wall and the transverse wall cooperating to substantially seal the first end of the tubular member and the opening from the cavity of the tubular member; and a handle member associated with at least one of the peripheral wall and the transverse wall, the handle member capable of elastically deforming the outer surface of the peripheral wall to, in turn, place the opening in fluid communication with the cavity, while maintaining the substantial seal of the first end of the tubular member.

2. The dispensing apparatus of claim 1 wherein the tubular member of the spout further comprises an outside surface, the outside surface of the tubular member further comprising a finger retention surface.

3. The dispensing apparatus of claim 2 wherein the finger retention surface comprises a depressed region and a raised region, the raised region positioned between the depressed region and the first end of the tubular member.

4. The dispensing apparatus of claim 3 wherein the raised region comprises a substantially uniform circular configuration having a first diameter and wherein the depressed region comprises a substantially uniform circular configuration having a second diameter, wherein the substantially uniform circular configurations arc substantially concentric and wherein the first diameter is greater than the second diameter.

5. The dispensing apparatus of claim 1 wherein the tubular member comprises a substantially cylindrical cross-sectional area.

6. The dispensing apparatus of claim 5 wherein a diameter of the inside surface of the tubular member proximate the first end is substantially equal to a diameter of the inside surface of the tubular member proximate the second end.

7. The dispensing apparatus of claim 1 wherein the tubular member further includes an outwardly extending flange positioned proximate the second end of the tubular member.

8. The dispensing apparatus of claim 1 wherein the spout further comprises a first mating structure and the spigot further comprises a second mating structure, the first mating structure and the second mating structure cooperating to substantially axially retain the spout relative to the spigot.

9. The dispensing apparatus of claim 8 wherein at least a portion of first mating structure is positioned between the first end of the tubular member and the opening of the tubular member.

10. The dispensing apparatus of claim 9 wherein the first mating structure comprises an annular channel encircling the inside surface of the tubular member.

11. The dispensing apparatus of claim 10 wherein the second mating structure comprises an annular ring encircling the outside surface of the peripheral wall.

12. The dispensing apparatus of claim 9 wherein the annular channel is substantially transverse to the tubular member.

13. The dispensing apparatus of claim 9 wherein the tubular member includes an outside surface having a raised region, the annular channel substantially corresponds the raised region positioned on the outside surface of the tubular member.

14. The dispensing apparatus of claim 1 wherein the handle member of the spigot includes a concave arcuate configuration to facilitate the grasping of and retention by a finger of a user.

15. The dispensing apparatus of claim 1 wherein the peripheral wall and the transverse wall of the spigot are substantially free of any openings extending therethrough.

16. The dispensing apparatus of claim 1 wherein the peripheral wall and the transverse wall are substantially perpendicular to each other.

17. The dispensing apparatus of claim 1 farther comprising an adhesive associated with each of the spout and the spigot the adhesive further facilitating the attachment thereof.

18. The dispensing apparatus of claim 1 wherein the tubular member further includes a directing member associated with the opening.

19. The dispensing apparatus of claim 1 wherein the spigot comprises an integrated molded component.

* * * * *